US009511271B2

(12) United States Patent
Colan et al.

(10) Patent No.: US 9,511,271 B2
(45) Date of Patent: Dec. 6, 2016

(54) TWO STAGE PROGRESSIVE RESISTANCE TRAINER

(71) Applicant: SportCrafters, Inc., Granger, IN (US)

(72) Inventors: Peter V. Colan, Elkhart, IN (US); Patrick T. Kulwicki, South Bend, IN (US)

(73) Assignee: SportCrafters, Inc., Granger, IN (US)

( * ) Notice: Subject to any disclaimer, the term of this patent is extended or adjusted under 35 U.S.C. 154(b) by 0 days.

(21) Appl. No.: 14/855,894

(22) Filed: Sep. 16, 2015

(65) Prior Publication Data

US 2016/0082310 A1 Mar. 24, 2016

Related U.S. Application Data

(60) Provisional application No. 62/052,151, filed on Sep. 18, 2014.

(51) Int. Cl.

| | |
|---|---|
| ***A63B 22/06*** | (2006.01) |
| ***A63B 69/16*** | (2006.01) |
| ***A63B 21/005*** | (2006.01) |
| ***A63B 21/00*** | (2006.01) |
| *A63B 21/22* | (2006.01) |

(52) U.S. Cl.

CPC ..... *A63B 69/16* (2013.01); *A63B 21/0051* (2013.01); *A63B 21/00069* (2013.01); *A63B 21/225* (2013.01); *A63B 2069/165* (2013.01); *A63B 2069/168* (2013.01)

(58) Field of Classification Search

USPC ..... 482/63

See application file for complete search history.

(56) References Cited

U.S. PATENT DOCUMENTS

| | | | | |
|---|---|---|---|---|
| 2,972,478 | A * | 2/1961 | Raines | A63B 69/16 211/22 |
| 5,031,901 | A * | 7/1991 | Saarinen | A63B 21/0051 310/191 |
| 5,382,208 | A * | 1/1995 | Hu | A63B 21/0051 482/61 |
| 5,433,681 | A * | 7/1995 | Minoura | A63B 21/0051 482/61 |
| 5,545,982 | A * | 8/1996 | Vlakancic | B62L 1/12 188/24.22 |
| 5,628,711 | A * | 5/1997 | Boucher | A63B 69/16 434/61 |
| 5,916,067 | A * | 6/1999 | Morasse | A63B 69/16 482/61 |
| 6,695,752 | B2 * | 2/2004 | Lee | A63B 21/0051 482/110 |
| 6,964,633 | B2 * | 11/2005 | Kolda | A63B 21/0051 482/63 |
| 7,011,607 | B2 * | 3/2006 | Kolda | A63B 21/0051 482/57 |

(Continued)

*Primary Examiner* — Stephen Crow

(74) *Attorney, Agent, or Firm* — Botkin & Hall, LLP

(57) ABSTRACT

A two-stage resistance trainer is provided having a first magnet that is in proximity to a rotating wheel, and a moveable second magnet that is linked to the first magnet. The first magnet is moved when the rotating wheel rotates and the second magnet is moved closer to the rotating wheel to add a second order effect to the resistance. The trainer is capable of adjusting the first magnet position in relation to the rotating wheel to provide a different relationship of speed to resistance.

18 Claims, 8 Drawing Sheets

(56) References Cited

U.S. PATENT DOCUMENTS

| | | | | |
|---|---|---|---|---|
| 7,077,789 | B1 * | 7/2006 | Chen | A63B 21/0051 482/63 |
| 7,314,434 | B2 * | 1/2008 | Chen | A63B 21/0051 188/164 |
| 7,326,151 | B2 * | 2/2008 | Peterson | A63B 22/16 482/57 |
| 7,530,933 | B2 * | 5/2009 | Chen | A63B 21/0051 482/61 |
| 7,766,798 | B2 * | 8/2010 | Hamilton | A63B 24/0087 434/61 |
| 7,955,228 | B2 * | 6/2011 | Hamilton | A63B 24/0087 482/61 |
| 2006/0229163 | A1 * | 10/2006 | Waters | A63B 22/0605 482/8 |
| 2011/0275488 | A1 * | 11/2011 | Hamilton | A63B 24/0087 482/61 |
| 2016/0082310 | A1 * | 3/2016 | Colan | A63B 69/16 482/63 |

* cited by examiner

TWO STAGE PROGRESSIVE RESISTANCE TRAINER

CROSS REFERENCE TO RELATED APPLICATIONS

This application claims the benefit of U.S. Provisional Application No. 62/052,151, filed Sep. 18, 2014, the disclosures of which are hereby incorporated by reference.

BACKGROUND OF THE INVENTION

Stationary bicycle trainers have been popular in the last few decades as a means to use an existing bicycle on a stationary device that provides resistance to pedaling without the need to also balance, as with a bicycle roller. In the current art, most bicycle trainers that do not rely on external power source, or are otherwise controlled by an electronic device, rely on some mechanical means of converting the bicyclist's kinetic energy to heat. To simulate realistic conditions of riding a bicycle on the road, it is well known that the relationship of power (the amount of resistance experienced by the cyclist) and speed is non-linear, meaning that the incremental power needed to increase speed increases with higher speed.

The most popular current means of simulating this non-linear relationship of power and speed is a fluidic clutch, much like the typical torque converter used in automatic transmissions in automobiles. Previous to the fluidic clutch, fans were popular and effective, but their popularity declined quickly after the introduction of the fluidic clutch because of the excessive noise inherent in fans. Other inventions in the past have used friction devices and magnetic devices of various architectures. The fluidic clutch devices, although mechanically simple, somewhat limit the ability of the cyclist to customize a power to speed relationship that may be desired. They are a single-stage device, meaning that the bicycle wheel drives the fluidic clutch directly. Fluidic clutch devices have a history of reliability problems because, over extended usage, the fluid seal can deteriorate, particularly in the presence of the heat that can build up in the fluid chamber.

Magnetic devices are also used, typically in a single-stage architecture, where the bicycle wheel drives a conductive plate or drum directly, and in the proximity of a fixed magnet, when the wheel drives the magnets in the proximity of a fixed conductive plate. Although inherently quiet and reliable, these have historically been limited in their ability to provide a non-linear relationship of power and speed through the full power range that is typical of realistic conditions and that professional cycling desires. Further, they typically work very well in the lower speed ranges but are limited in providing top end power at high speeds; or the opposite is true where they work well in the top end, but are limited in capability at the lower speed range. Friction devices, although capable of providing good top-end performance, will wear and change their characteristics of speed and power over time in the nominal and lower power range.

SUMMARY OF THE INVENTION

The invention takes advantage of the reliability and quiet performance of magnets, but separates the magnetic resistance mechanism into two stages. The first-stage is a device that consumes relatively little energy and moves in response to a light magnetic drag between a first-stage magnet and a conductive surface being driven by the bicycle wheel. The second-stage uses a more powerful magnet and controls the engagement of the magnet to a conductive surface in response to the motion of the first stage. The second stage magnet converts kinetic energy to heat by creating stronger eddy currents within the conductive material. Also contained within the second stage is an optional friction device that is only engaged at the top end of the power range after the second stage magnets reach their peak in their ability to provide continuing non-linear power growth with speed.

BRIEF DESCRIPTION OF THE DRAWINGS

A preferred embodiment of this invention has been chosen wherein:

FIG. 3 is a side view of the resistance device with the flywheel stationary and the first magnet in a far starting position;

DESCRIPTION OF THE PREFERRED EMBODIMENT

Figure 1:
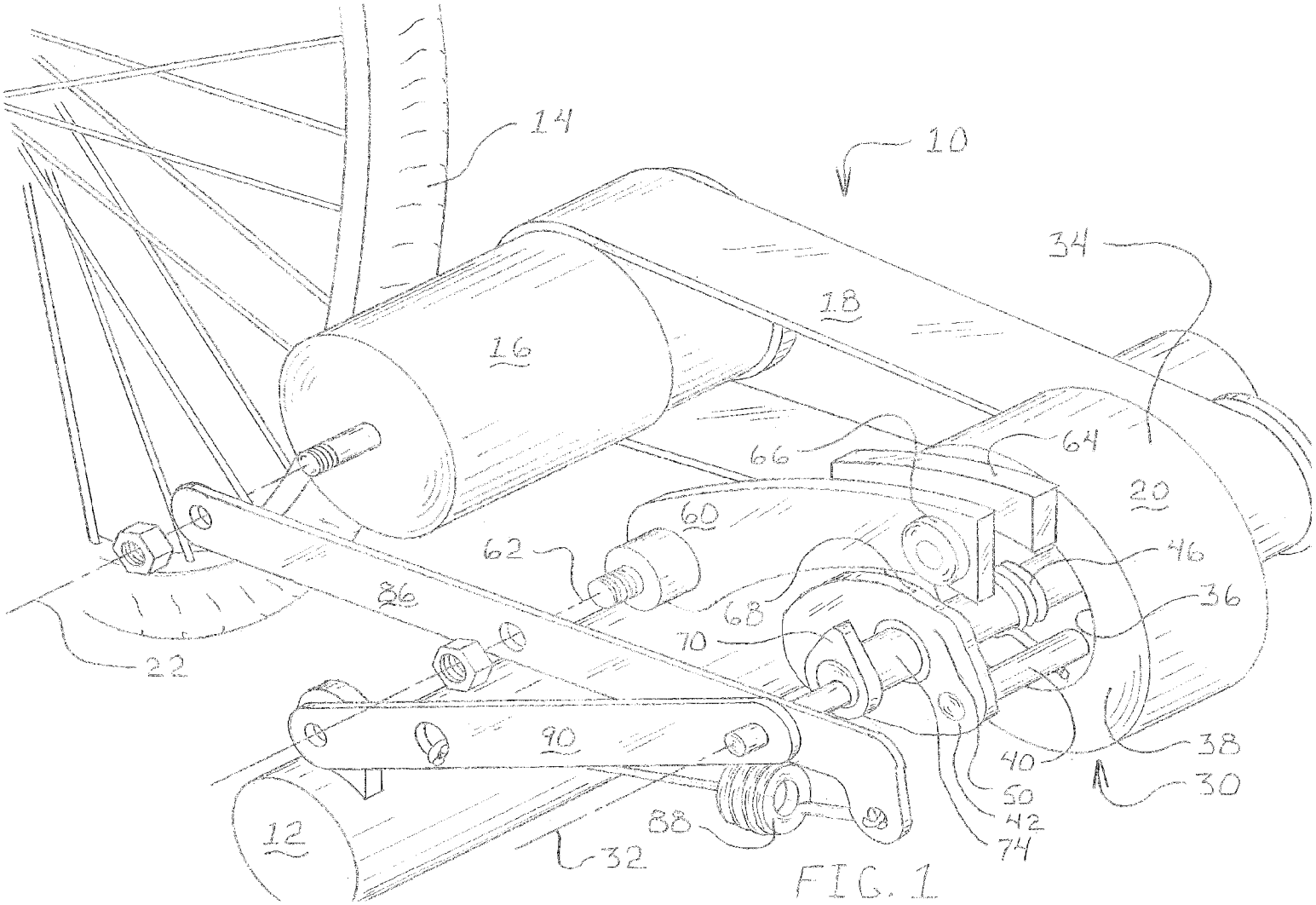
FIG. 1 is a partially exploded isometric view of the trainer.
Figure 2:
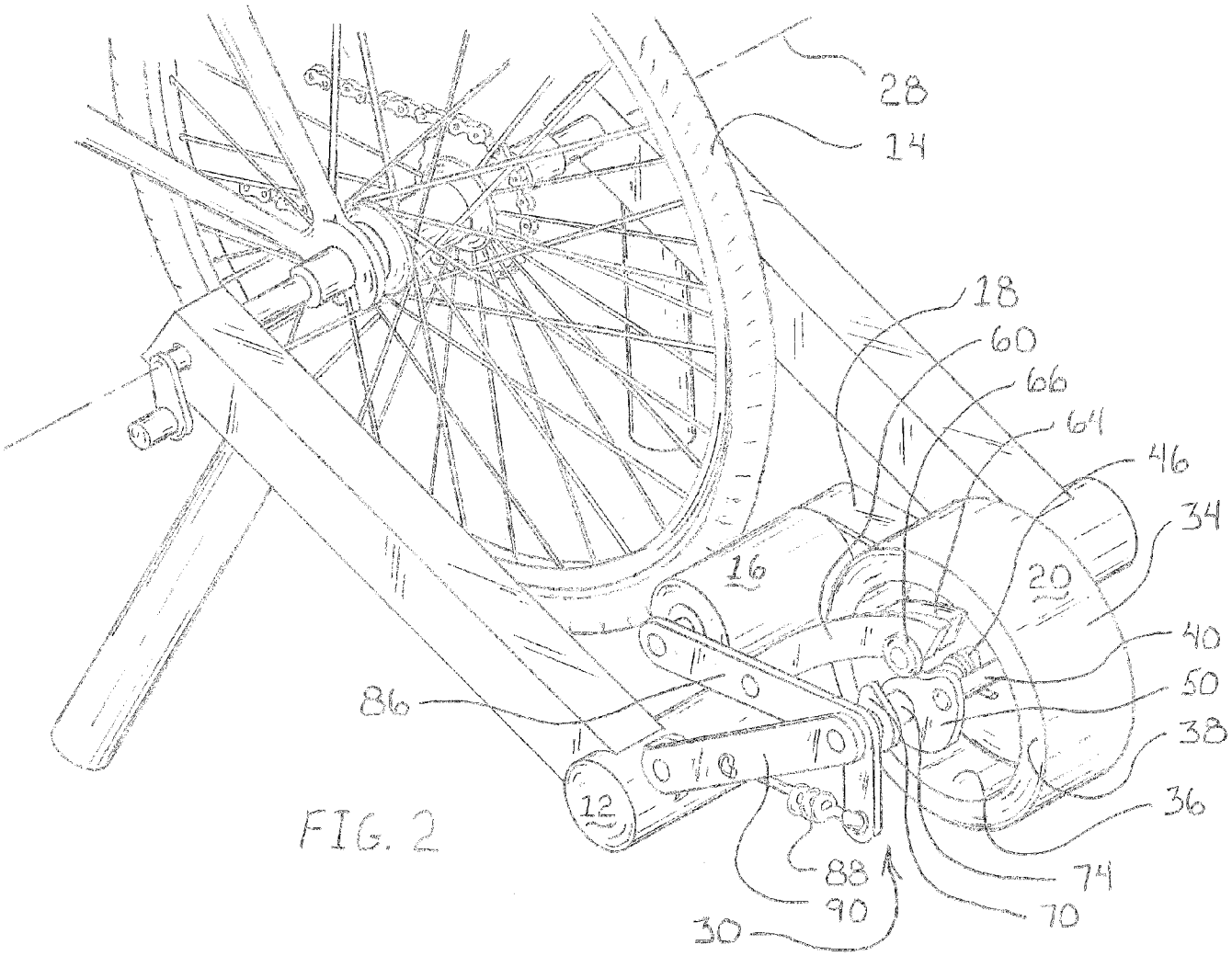
FIG. 2 is an isometric view of the trainer.
Figure 7:
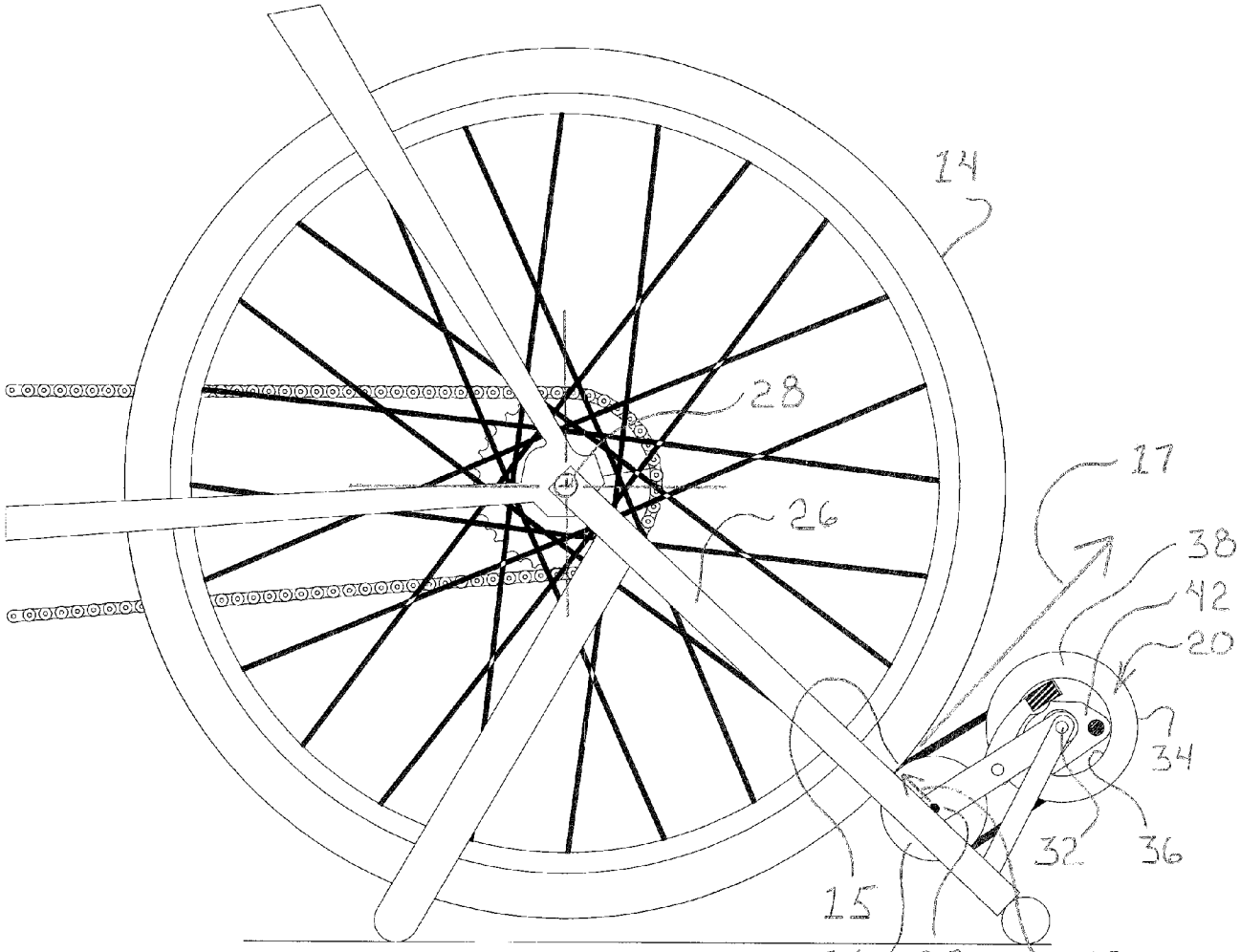
FIG. 7 is a side view of the trainer as mounted to the rear wheel of a bicycle and having an automatic tire compression feature.
Figure 8:
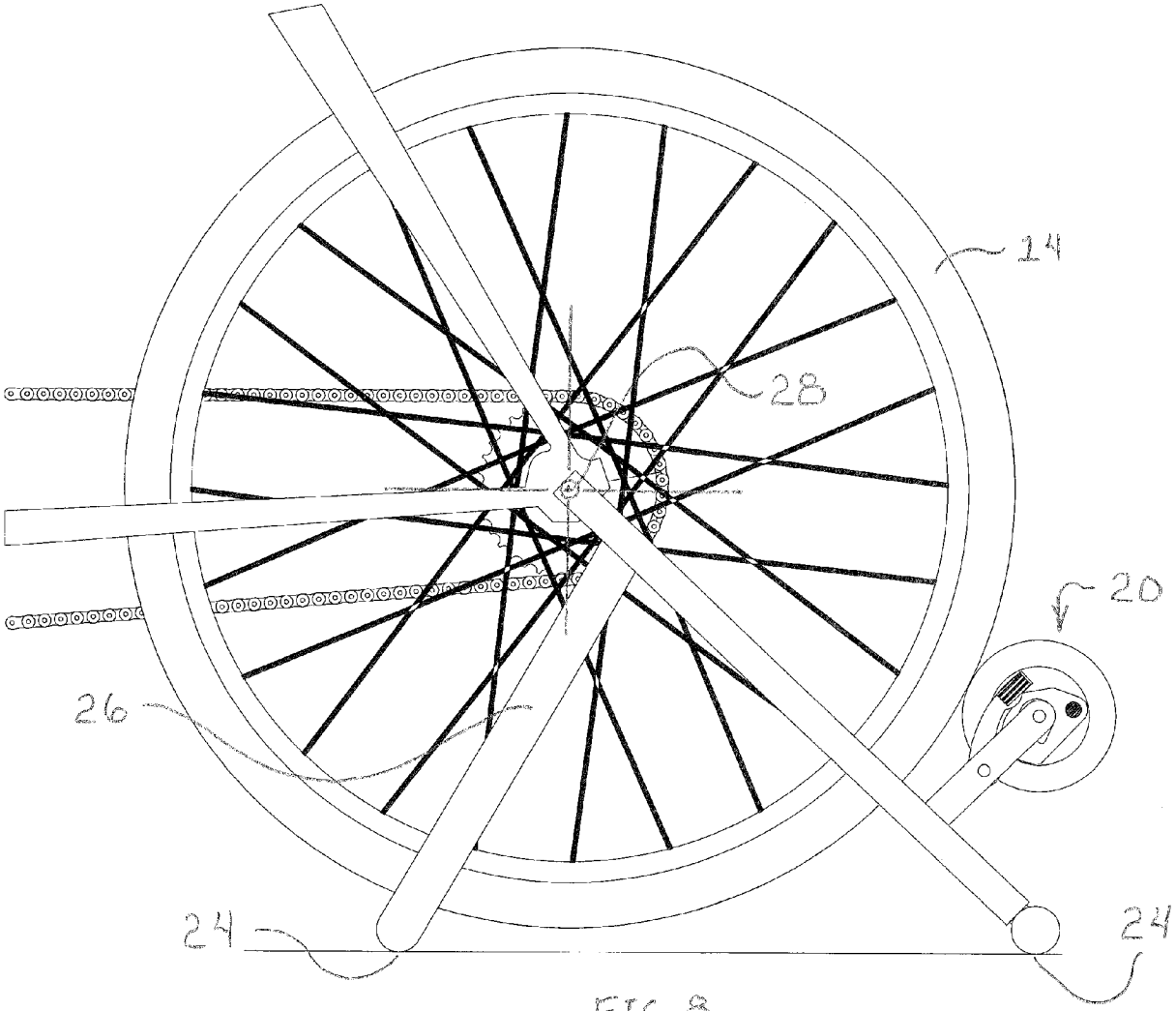
FIG. 8 is a side view of the trainer as mounted to the rear wheel of a bicycle.

As shown in FIGS. 1 and 2, a two-stage progressive resistance trainer 10 has a frame 12 that is attached to a bicycle tire 14. The frame 12 has a stabilizing portion 24 and an axle mounting portion 26 as shown in FIGS. 7 and 8. As is commonly known in the art, a rear tire 14 is driven by a crank through a chain and series of sprockets. As the user rotates the crank, the driving gear pulls on the chain. Movement of the chain causes the rear sprocket to begin turning. The rear sprocket drives the rear wheel about a rotational axis 28. Tires on most bicycles are pneumatic, meaning that air pressure internal to the tire causes the tire to maintain its shape. The air also acts as a cushion to absorb surface irregularities and allows the user to adjust ride quality by increasing or decreasing the pressure. The tire 14 rotates about the rotational axis 28 and drives rotating portions of the trainer 10. The tire 14 drives a driven cylinder 16 as shown in FIG. 7 or the flywheel 20 directly as shown in FIG. 8. The driven cylinder 16 rotates about a driven axis 22.

As is known in the art, eddy current devices use a permanent magnet in proximity to a conductive metal, usually copper or aluminum, to generate a resistance to movement. When the magnet is moving in relation to the conductive metal, eddy currents are generated in the conductive metal, and this creates a magnetic coupling. Eddy currents are generated when there is movement between the conductive metal and the permanent magnet. By moving the magnet in relation to the conductive metal in relatively close proximity, the eddy currents generated create non-contacting drag. The drag generates heat in the conductive metal. By varying the amount of magnetism that is passing through the metal, the amount of eddy currents generated can be controlled as they relate to the speed between the two parts. This is typically done by moving the magnet closer or farther away or having a portion of the magnet overlap the conductive metal. By increasing the amount of overlap or decreasing the distance between the two parts, the eddy currents generated increase, thereby increasing the drag.

Figure 4:
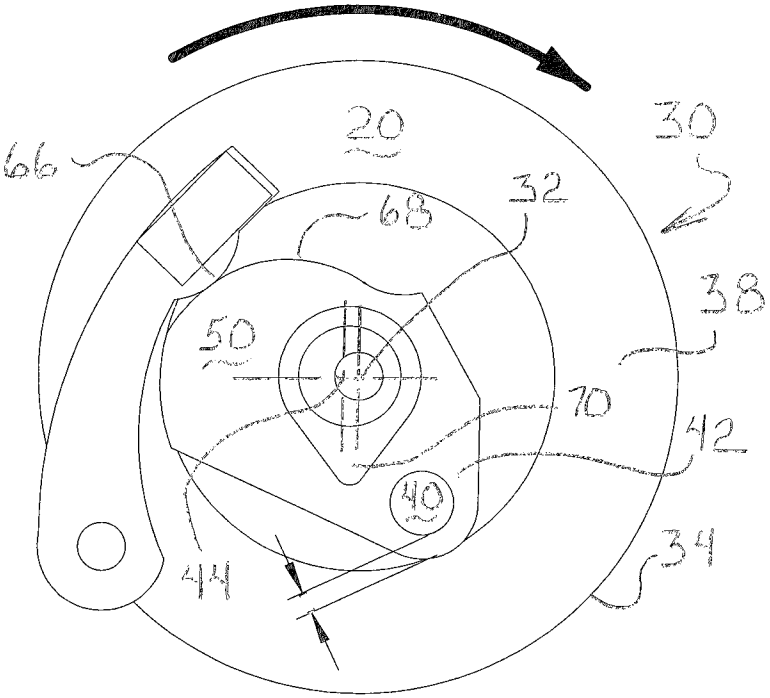
FIG. 4 is a side view of the resistance device with the flywheel rotating and the first magnet in a far starting position.
Figure 5:
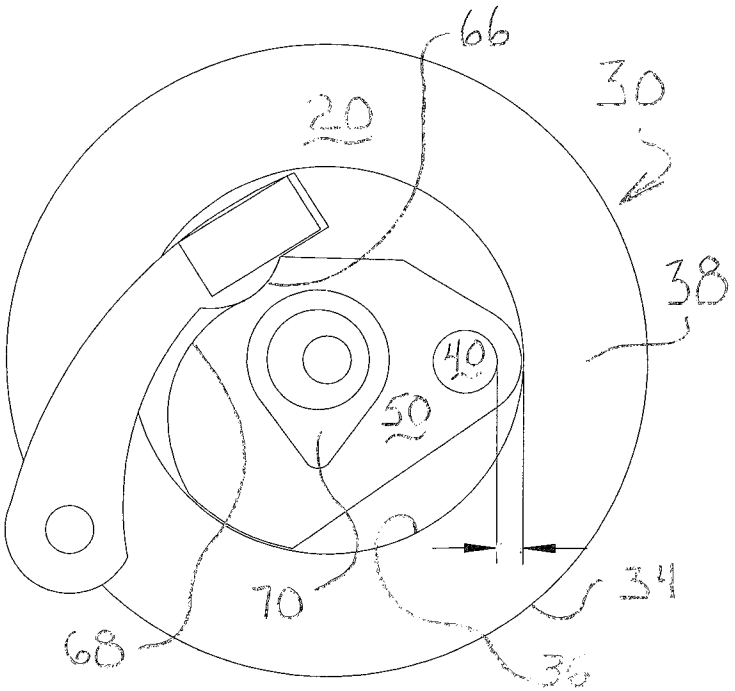
FIG. 5 is a side view of the resistance device with the flywheel stationary and the first magnet it a close starting position.
Figure 6:
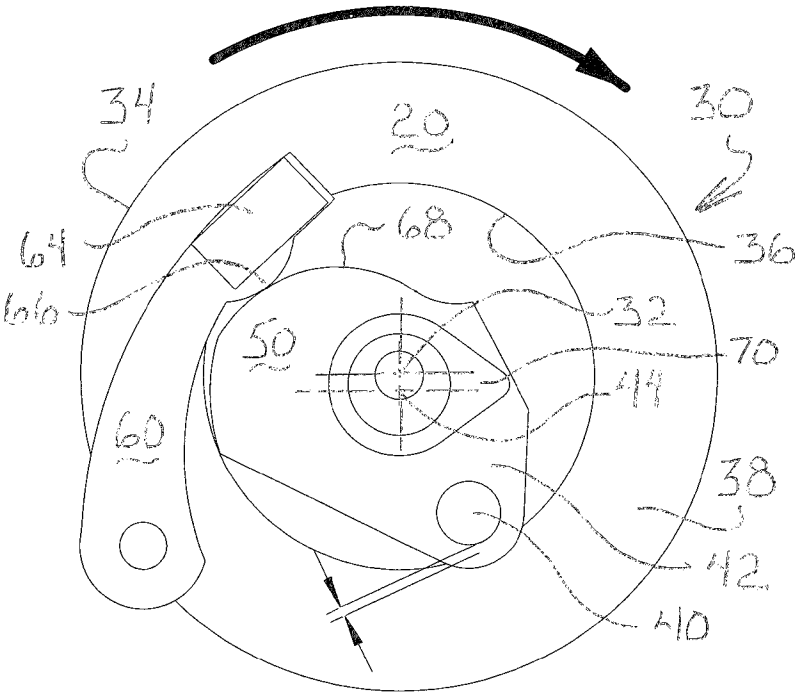
FIG. 6 is a side view of the resistance device with the flywheel rotating and the first magnet in a close starting position.
Figure 5:
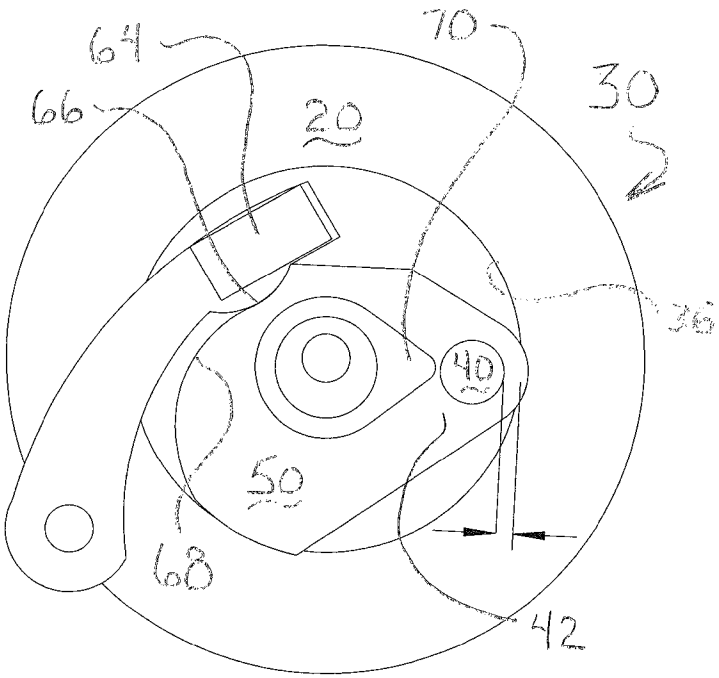
Figure 9:
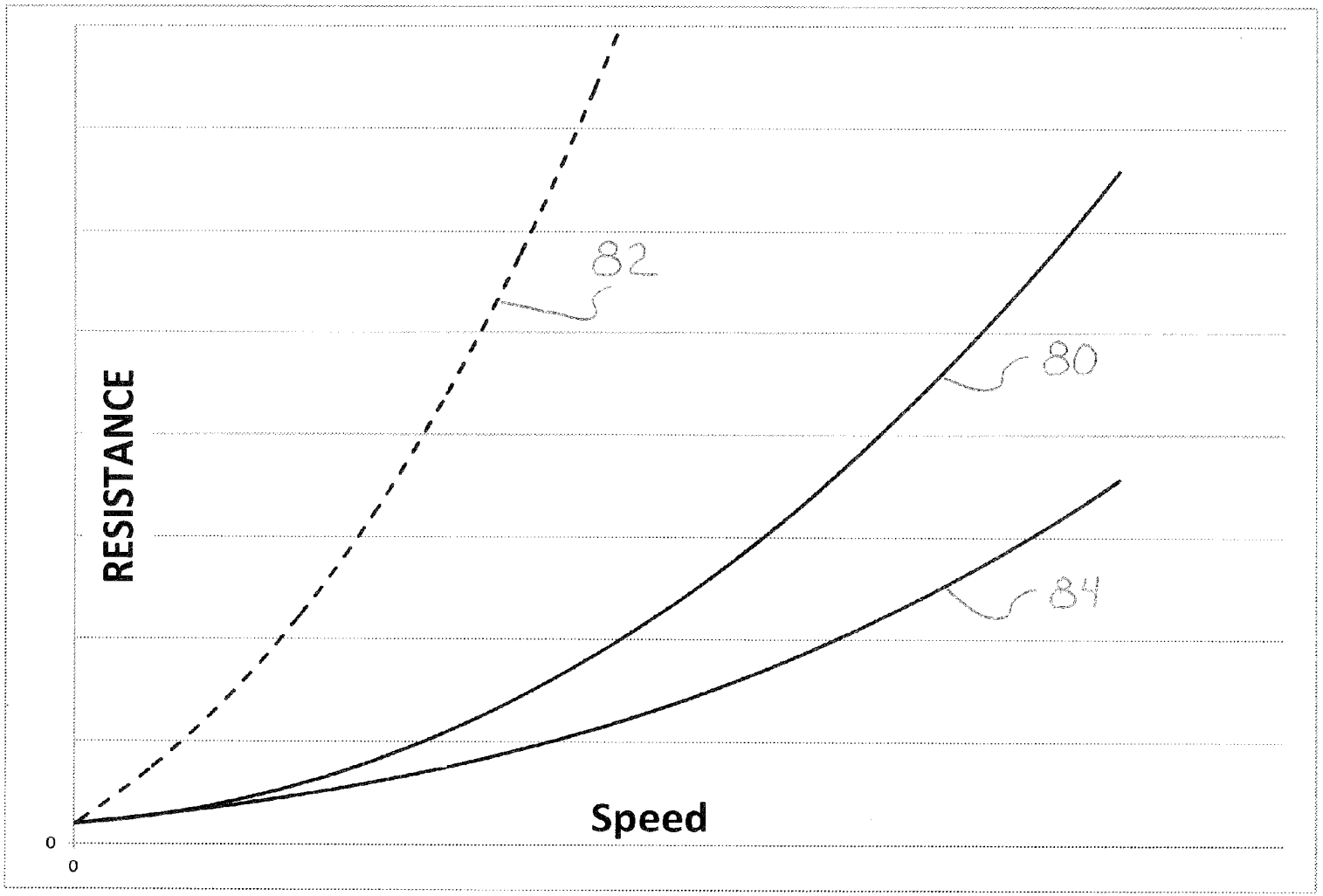
FIG. 9 is a graph showing the resistance vs speed for the first magnet in the close starting position, an intermediate position, and the far starting position.
Figure 10:
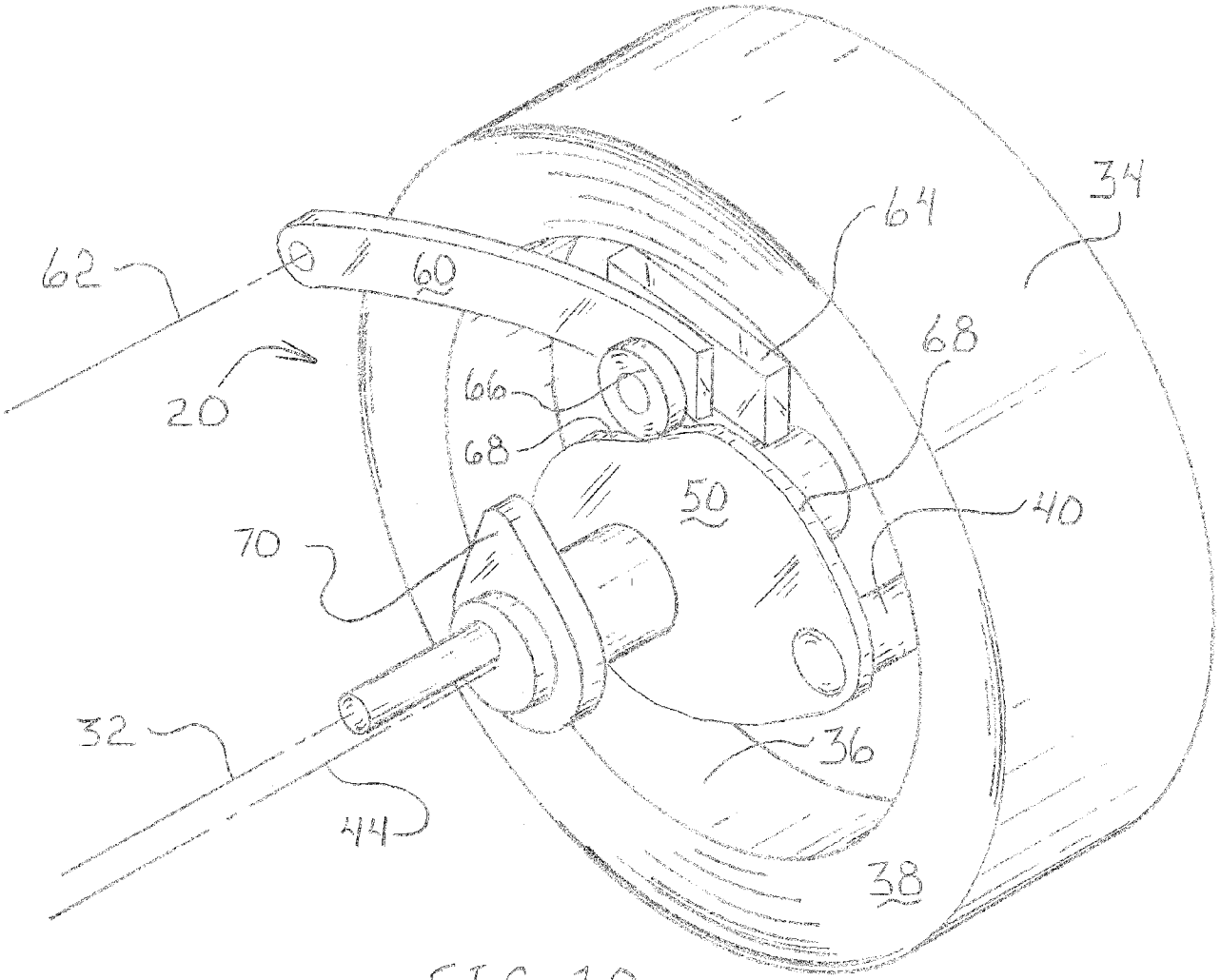
FIG. 10 is an assembled isometric view of a portion of the resistance device shown in FIG. 1.

The resistance device 30 has a rotating flywheel 20 that is made from a conductive metal such as aluminum. The flywheel 20 rotates about a central axis 32. The device 30, as shown, is a thick-walled cylinder with an outside diameter 34, and inside diameter 36 and a side wall 38. Inside the flywheel 20 and close to the inside diameter 36 is a first magnet 40. The first magnet 40 rides on a magnet carrier 42 as shown in FIG. 1. In the embodiment shown, the magnet carrier 42 rotates about an offset axis 44 that is parallel to the central axis 32 as shown in FIGS. 4 and 6. By offsetting the axis 44 where the first magnet 40 rotates, the first magnet 40 can move from a position where it is relatively far from the inside diameter 36 to a position where it is relatively close. The movement between the far position and the close position is demonstrated by FIGS. 3-4 and 5-6. The first magnet 40 and magnet carrier 42 have a spring 46 as shown in FIG. 1 to bias the magnet 40 to the farther position. As the flywheel 20 begins to rotate, eddy currents are generated in the flywheel 20. The eddy currents create a force that tries to pull the first magnet 40 along with the flywheel 20. This, in turn, causes the magnet carrier 42 to begin to rotate once it overcomes the force of the spring 46. As the magnet carrier 42 rotates, the gap between the first magnet 40 and the inside of the flywheel 20 decreases, causing an increased amount of eddy currents in the flywheel 20. However, the amount of eddy currents is minimal and creates minimal drag. This is different from other progressive resistance eddy current resistance mechanisms. It is contemplated that the offset axis 44 of the magnet carrier 42 is aligned with the central axis 32. This would mean the first magnet 40 would remain at a constant distance from the inside and still rotate as the speed of the flywheel 20 increases. The purpose of the lower amount of eddy currents is to create a lower resistance at low speeds, similar to a typical bicycle. The first magnet 40 and the inside of the flywheel 20 make up the first stage of the device. Attached to the magnet carrier 42 is a cam 50 that rotates when the carrier 42 and magnet 40 rotate. An adjustment knob 70 allows the user to adjust the resting position of the magnet carrier 42 and therefore the starting distance between the first magnet 40 and the surface of the flywheel 20. The adjustable resting position of the magnet carrier 42 allows the user to change the movement of the magnet carrier 42 as it relates to the speed of the flywheel 20. When the adjustment knob 70 has the starting distance of the first magnet 40 relatively far from the inside diameter 36 of the flywheel 20 as is shown in FIG. 3, the response curve is closer to the relationship of speed to resistance represented by line 84 as shown in FIG. 9. When the adjustment knob 70 has the starting distance of the first magnet 40 that is closer to inside diameter 36 of the flywheel 20 as is shown in FIG. 5, the response curve is closer to line 82 as shown in FIG. 9.

To accomplish the second order effect, a second magnet 64 needs to be selectively moved in close proximity to the sidewall 38. In the present embodiment, this is done using a cam follower 60 however it is contemplated that any means to cause relative motion between the first magnet 40 and second magnet 64 could be employed such as linkages, etc. The cam follower 60 pivots about a follower axis 62. The follower axis 62 is offset from the central axis 32. The cam follower 60 has a bearing 66 that rides on a cam surface 68 that is part of the cam 50. In the current embodiment of the trainer 10, the bearing 66 on the cam follower 60 maintains contact with the cam surface 68 through gravity, but a spring could also be used. The bearing 66 allows a smooth movement between the cam surface 68 and the cam follower 60. Attached to the cam follower 60 is a second magnet 64, making the second stage of the device. The second magnet 64 is adjacent to the side wall 38. The side wall 38 has sufficient width for the second magnet 64 to significantly overlap to generate the second stage resistance. The cam follower 60 moves the second magnet 64 between a resting position and an active position. The resting position is where the second magnet 64 does not have much overlap as is shown in FIGS. 3 and 5. When the cam 50 moves to an active position as is shown in FIGS. 4 and 6, the cam follower 60 moves the second magnet 64 to a position where there is overlap of the second magnet 64 and the side wall 38. It is also contemplated that the second magnet 64 can be moved in relation to the flywheel 20 through other means, such as axially or radially on the outside diameter 34 of the flywheel 20. The cam 50 could move the cam follower 60 and therefore second magnet 64 along the follower axis 62 to vary the amount of eddy current drag by changing the gap between the two.

The main purpose of the magnet carrier 42 and first magnet 40 is to cause the cam 50 to rotate and move the cam follower 60 to a position where the second magnet 64 will have more overlap to the side wall 38 of the flywheel 20. This provides a more realistic speed to drag relationship. The relationship of speed to drag is shown in FIG. 9. The load line 80 shows the progressive nature of the resistance device 30. The line 82 is where the adjustment knob 70 for the cam 50 is rotated to put the resting and active positions of the first magnet 40 in closer proximity to the flywheel 20 as shown in FIG. 5-6. The line 84 is where the adjustment knob 70 is rotated to put the resting and active positions of the first magnet 40 further from the flywheel 20, as shown in FIG. 3-4. When the resting position of the magnet is closer to the flywheel 20 as is shown in FIG. 5, the cam follower 60 moves into position at a slower rotational speed of the flywheel 20.

If the drag at the top end of the drag curve is not sufficient, it is contemplated that a friction device, third magnetic device, or other resistance device can be implemented to add additional resistance that the second stage cannot provide.

As is shown in FIGS. 1, 2, and 7, the resistance device 30 can be incorporated as part of a self-compensating tire compression device. The self-compensating system, as shown, is made up of a frame 12, a pivoting arm 86, and the resistance device 30. The frame 12 has a lower surface which is designed to rest on the ground. Attached to the frame 12 is a frame member 90. A pivot arm 86 has a pivot point about which the pivot arm 86, shown in FIG. 1, pivots. The pivot arm 86 includes the driven wheel 16 that rotates about the driven axis 22. The driven wheel 16 contacts the rear tire 14 at a contact point 15 as shown in FIG. 7. The contact point 15 is tangent to both the rear tire 14 and the driven wheel 16. The driven wheel 16 is held in biased contact with the tire 14 via a spring 88, shown in FIG. 1. The spring 88 holds the pivot arm 86 with enough static force for the tire 14 to begin rotating against the driven wheel 16 without slippage. A portion of the driven wheel 16 is a pulley that drives a belt 18, which in turn drives a pulley portion of the resistance device 30. As stated previously, resistance devices are well known in the art of bicycle trainers. The driven wheel 16 typically would have a lower mass than a normal resistance device to allow responsiveness to speed and load. Using different sized pulleys or sprockets, as is shown in FIG. 1, the ratio between the driven wheel 16 and the resistance device 30 can be multiplied or divided. This is done based on the load characteristics of the resistance device 30 to simulate a more realistic resistance to speed ratio and based on the rider's needs. As the tire 14 increases in speed, the resistance device 30 creates drag by resisting rotation. This drag creates an imaginary line of force that travels from the contact point 15 to the pivot axis 32, which corresponds to the central axis 32 of the flywheel 20. Because the pivot point is located between the tangent line and the normal force line, the force is split into a tangent force and a normal force. The normal force is increased as a proportion of the force. If the pivot point was intersected by the tangent force line, the normal force would remain the same regardless of the drag in the system. If the pivot point was intersected by the normal force, the driven wheel 16 would be simply pushed out of the way as the tire 14 rotates. Power and torque are directly related. The tangential force creates a moment about the pivot point of the pivot arm 86 calculated as Tangential force*B. This moment is reacted by the normal force*A. These two forces are constrained to be equal, so tangential force*B=normal force*A. This can be rewritten as A/B=Tangential force/Normal force. The coefficient of friction is the force required to move the two sliding surfaces over each other (tangential force), divided by the force holding them together, (normal force). So long as the ratio of tangential force to normal force remains lower than the coefficient of friction between the tire 14 and the driven wheel 16, the tire 14 will not slip. This relationship also defines the relationship of dimension A to dimension B.

The frame 12 is shown attaching directly to the rear axle but it is contemplated that the trainer 10 could attach to any portion of the frame 12 of the bicycle. As shown in FIGS. 1 and 2, a pivot arm 86 includes a driven wheel 16 that rotates about a driven axis 22. The driven wheel 16 has an outside diameter 34 where it contacts the outside surface of the rear tire 14 at a contact point 15. As shown in FIG. 4, the contact point 15 is tangent to both the rear tire 14 and the driven wheel 16.

At rest, the normal force 19 from the driven wheel 16 is from the spring 88. Once the driven wheel 16 begins moving, the resistance device 30 begins to cause drag in the system. The drag creates a force that is a line that intersects the contact point and the pivot point. Because the force is at an angle to the tangential force and the normal force 19, the force resists the tangential force created by the tire 14. The force is a compressive force between the pivot point and the point of contact 15 between the outside surface and the outside diameter 34 of the driven wheel 16. The reaction force is split into two components, one of those components adds into the normal force 19. The moment is counterclockwise when the tire 14 is rotating clockwise.

As shown in FIG. 4, the tire 14 increasing in speed causes the driven wheel 16 to create drag by resisting rotation. It either creates drag directly or has drag created by another driven device. This drag creates a line of applied force that travels from the contact point 15 to the pivot point that is shown on the central axis 32. Because the pivot point is not located on the tangent line or the normal force 19 line, the applied force is split into a tangent force 17 and a normal force 19. The normal force 19 is increased as a proportion of the applied force.

It is understood that while certain aspects of the disclosed subject matter have been shown and described, the disclosed subject matter is not limited thereto and encompasses various other embodiments and aspects. No specific limitation with respect to the specific embodiments disclosed herein is intended or should be inferred. Modifications may be made to the disclosed subject matter as set forth in the following claims.

What is claimed is:

1. A two-stage trainer for use with a driving mechanism having a driving wheel, said driving wheel rotatable with respect to said driving mechanism about a first rotational axis, said trainer comprising:

a frame having a mounting portion adapted to releasably affix said first rotational axis of said driving mechanism with respect to said frame;

a pivot arm being pivotably affixed to said frame about a pivot axis;

a resistance device having a cylinder rotatably affixed about a central axis and resisting rotation with respect to said central axis, said resistance device having an outer wall defining an inner chamber, said resistance device affixed to said pivot arm, said central axis being substantially parallel to said pivot axis;

a first magnet partially located in said inner chamber and rotatable with respect to said central axis, said first magnet movable between a first position corresponding to when said cylinder is at rest and a second position when said cylinder rotates;

a second magnet moveable between a first and second position, said first position defined by said second magnet being located at a relatively far distance from said cylinder and said second position defined by said second magnet being relatively close to said cylinder, said second magnet being linked to said first magnet so that movement of said first magnet from its said first position toward its said second position causes movement of said second magnet from its said first position toward its said second position;

a biased contact point located where said resistance device contacts said driving wheel when said driving mechanism is affixed to said mounting portion of said frame, said resistance device being urged toward said driving wheel by a biasing force; and said biasing force increasing from a relatively low force when said resistance device has a relatively low resistance to rotation and a relatively high force when said resistance device has a relatively high resistance to rotation.

2. The trainer of claim 1, said first magnet rotatable about an offset axis parallel to said central axis, said first position defined by said first magnet being relatively far from said cylinder, said second position defined by said first magnet being relatively close to said cylinder.

3. The trainer of claim 2, said offset axis being fixably movable with respect to said central axis.

4. The trainer of claim 1, said resistance device being a progressive resistance device.

5. The trainer of claim 1, said resistance device having a driven cylinder connected to said cylinder, so that rotation of said driven cylinder rotates said cylinder.

6. The trainer of claim 1, said first position of said second magnet defined by said second magnet being located at a position with relatively small amount of overlay of said cylinder, said second position of said second magnet defined by said second magnet having a relatively large amount of overlay of said cylinder.

7. A two-stage trainer for use with a driving mechanism having a driving wheel, said wheel rotatable with respect to said driving mechanism about a first rotational axis, said trainer comprising:

a frame having a mounting portion adapted to releasably affix said driving mechanism with respect to said frame;

a resistance device having a cylinder rotatably affixed about a central axis affixed to said frame and resisting rotation with respect to said central axis, said resistance device having an outer wall defining an inner chamber;

a first magnet rotatable with respect to said central axis, said first magnet movable between a first position corresponding to when said cylinder is at rest and a second position when said cylinder rotates; and a second magnet moveable between a first and second position, said first position defined by said second magnet being located at a relatively far distance from said cylinder and said second position defined by said second magnet being relatively close to said cylinder, said second magnet being linked to said first magnet so that movement of said first magnet from its said first position toward its said second position causes movement of said second magnet from its said first position toward its said second position.

8. The trainer of claim 7, said resistance device being urged toward said driving wheel by a biasing force, said biasing force increasing from a relatively low force when said resistance device has a relatively low resistance to rotation and a relatively high force when said resistance device has a relatively high resistance to rotation.

9. The trainer of claim 8, a biased contact point located where said resistance device contacts said driving wheel when said driving mechanism is affixed to said mounting portion of said frame.

10. The trainer of claim 9, said first magnet rotatable about an offset axis parallel to said central axis, said first position defined by said first magnet being relatively far from said cylinder, said second position defined by said first magnet being relatively close to said cylinder.

11. The trainer of claim 10, said offset axis fixably movable with respect to said central axis to move said first magnet between a first distance and a second distance from said cylinder.

12. The trainer of claim 9, said cylinder having an end with a face, said second magnet overlaying a portion of said face in said second position.

13. The trainer of claim 7, said first position of said second magnet defined by said second magnet being located at a position with relatively small amount of overlay of said cylinder, said second position of said second magnet defined by said second magnet having a relatively large amount of overlay of said cylinder.

14. A two-stage trainer for use with a driving mechanism having a driving wheel, said wheel rotatable with respect to said driving mechanism about a first rotational axis, said trainer comprising:

a frame having a mounting portion adapted to releasably affix said first rotational axis of said driving mechanism with respect to said frame;

a resistance device being a cylinder rotatably affixed about a central axis affixed to said frame and resisting rotation with respect to said central axis, a first magnet rotatable with respect to said central axis, said first magnet movable between a first position corresponding to when said cylinder is at rest and a second position when said cylinder rotates;

a second magnet moveable between a first and second position, said first position defined by said second magnet being located at a relatively far distance from said cylinder and said second position defined by said second magnet being relatively close to said cylinder, said second magnet being linked to said first magnet so that movement of said first magnet from its said first position toward its said second position causes movement of said second magnet from its said first position toward its said second position; and said first magnet rotatable about an offset axis parallel to said central axis, said first position defined by said magnet being relatively far from said cylinder, said second position defined by said first magnet being relatively close to said cylinder.

15. The trainer of claim 14, said resistance device being urged toward said driving wheel by a biasing force, said biasing force increasing from a relatively low force when said resistance device has a relatively low resistance to rotation and a relatively high force when said resistance device has a relatively high resistance to rotation.

16. The trainer of claim 14, said offset axis fixably movable with respect to said central axis. to move said first magnet between a first distance and a second distance from said cylinder.

17. The trainer of claim 16, said cylinder having an end with a face, said second magnet overlaying a portion of said face in said second position.

18. The trainer of claim 14, said first position of said second magnet defined by said second magnet being located at a position with relatively small amount of overlay of said cylinder, said second position of said second magnet defined by said second magnet having a relatively large amount of overlay of said cylinder.

* * * * *